US008876533B2

(12) United States Patent
Axerud

(10) Patent No.: US 8,876,533 B2
(45) Date of Patent: Nov. 4, 2014

(54) EVALUATING SYSTEM AND METHOD FOR SHOOTING TRAINING

(75) Inventor: Alf Axerud, Huskvarna (SE)

(73) Assignee: SAAB AB, Linköping (SE)

( * ) Notice: Subject to any disclaimer, the term of this patent is extended or adjusted under 35 U.S.C. 154(b) by 497 days.

(21) Appl. No.: 12/494,975

(22) Filed: Jun. 30, 2009

(65) Prior Publication Data

US 2010/0003642 A1 Jan. 7, 2010

(30) Foreign Application Priority Data

Jun. 30, 2008 (EP) ..... 08159329

(51) Int. Cl.

| | |
|---|---|
| ***F41A 33/00*** | (2006.01) |
| ***F41G 3/26*** | (2006.01) |
| ***F41J 5/00*** | (2006.01) |
| ***F41J 11/00*** | (2009.01) |

(52) U.S. Cl.

CPC . *F41J 11/00* (2013.01); *F41G 3/26* (2013.01); *F41J 5/00* (2013.01)

USPC ..... 434/16; 434/19

(58) Field of Classification Search

USPC ..... 434/16, 18–23

See application file for complete search history.

(56) References Cited

U.S. PATENT DOCUMENTS

| | | | | | |
|---|---|---|---|---|---|
| 4,478,581 | A | * | 10/1984 | Goda | 434/22 |
| 4,682,953 | A | * | 7/1987 | Doerfel et al. | 434/16 |
| 4,793,811 | A | * | 12/1988 | Eichweber | 434/22 |
| 5,474,452 | A | * | 12/1995 | Campagnuolo | 434/11 |
| 6,977,593 | B2 | * | 12/2005 | Schmedemann et al. | 434/11 |
| 2007/0077539 | A1 | * | 4/2007 | Tzidon et al. | 434/21 |
| 2007/0238073 | A1 | * | 10/2007 | Portoghese et al. | 434/21 |
| 2008/0160486 | A1 | * | 7/2008 | Tengblad | 434/19 |
| 2009/0081619 | A1 | * | 3/2009 | Miasnik | 434/21 |

FOREIGN PATENT DOCUMENTS

| | | | |
|---|---|---|---|
| EP | 1359386 | A | 11/2003 |
| EP | 1359386 | A1 * | 11/2003 |
| JP | 08303997 | A | 11/1996 |
| WO | WO 0190676 | A1 * | 11/2001 |

OTHER PUBLICATIONS

European Search Report—Nov. 7, 2008.

* cited by examiner

*Primary Examiner* — Robert J Utama
*Assistant Examiner* — Sadaruz Zaman
(74) *Attorney, Agent, or Firm* — Venable LLP; Eric J. Franklin

(57) ABSTRACT

An evaluation system for shooting training. The evaluation system is arranged to determine from which shooter fired ammunition detected by a target system originates. The evaluation system includes a receiver unit arranged to receive shooter messages from a plurality of weapon systems and to receive a target message from the target system. Each shooter message includes time marked firing information and first pairing information related to a weapon of the weapon system. Each target message includes time marked hit/miss information and second pairing information related to a target of the target system. The evaluation system further includes a processing unit arranged to pair the target with one associated weapon based on the target message and each respective shooter message. Also, a method for determining from where ammunition detected at a target was fired.

16 Claims, 4 Drawing Sheets

EVALUATING SYSTEM AND METHOD FOR SHOOTING TRAINING

CROSS-REFERENCE TO RELATED APPLICATIONS

This application claims priority to European patent application 08159329.5 filed 30 Jun. 2008.

TECHNICAL FIELD

The present invention relates to the technical field of shooting training. Particularly, it relates to fire evaluation in training with live ammunition.

BACKGROUND ART

In shooting practice with live ammunition, the participants are usually lined-up on a line. The participants are then from there practicing shooting against a target set comprising one or a plurality of targets. The hit results from each participant can thereafter be evaluated, if it can be determined from which shooter an ammunition is fired.

There exists various target mechanisms for target practice, which can be comprised in the target set. There are for example target mechanisms which are able to suddenly display a target in various positions and in different configurations in front of the participants. For example, the mechanism is in one example arranged to make the target visible by a so-called pop-up, a swing-out, or a rotary movement of the target. Further, the targets can be arranged to move on rails or the like, so as to be movable in front of the participants.

In order to enhance the value of the practice, the participants can be allowed to move in relation to the target set. However, it will then be even more difficult to determine from which shooter an ammunition was fired.

SUMMARY OF THE INVENTION

One object of the present invention is provide a way of determining from which shooter a detected ammunition is fired so as to enable evaluation of the shooting practice.

This is in one embodiment of the present invention achieved by means of an evaluation system for shooting training arranged to determine from which shooter ammunition detected by a target system is fired. The evaluation system comprises a receiver unit arranged to receive shooter messages from a plurality of weapon systems and to receive target messages from the target system, and a processing unit arranged to pair the target object with one associated weapon. Each shooter message comprises time marked firing information and first pairing information related to a weapon of the weapon system. The target message comprises time marked hit/miss information and second pairing information related to a target of the target system. The processing unit is arranged to pair the target object with the one associated weapon based on the target message and each respective shooter message.

One advantage of the present invention is that the shooter from which detected ammunition was fired can be detected even if the shooter is moving around. Further, the evaluation system does not require the presence of any positioning system providing position information for the shooting systems and the at least one target system. However, for example a satellite based positioning system such as GPS could be used by the shooting systems and/or target systems for providing position information so as to enhance the pairing probability of the evaluation system.

In one embodiment, the processing unit is arranged to

- determine a first time of flight value related to a time difference between the hit/miss information of the target message and the firing information of each shooter message,
- determine a second time of flight value based on the second pairing information of the target message and the first pairing information of each shooter message, and
- pair the target object with one associated weapon based on the first and second time of flight values.

The first pairing information comprises for example information related to flight characteristics of the ammunition and/or weapon.

The second pairing information comprises for example information related to a velocity of the ammunition at the target, and wherein the processing unit is arranged to determine the second time of flight value based on the characteristics of the flight of the ammunition and the velocity of the ammunition at the target.

The first and second pairing information comprises for example information related to the position of the weapon and the target object, respectively, and the processing unit is arranged to determine the second time of flight value for each weapon based on the characteristics of the flight of the ammunition and a determined distance between the weapon and the target.

In one example, the processing unit is further arranged to pair the target with the associated weapon based on angle of attack pairing. Accordingly, the first pairing information can comprise information related to an angle of attack of the weapon and the first and second pairing information can comprise information related to the position of the weapon and the target object, respectively. The processing unit is then arranged to determine a first angle of attack value based on the angle of attack information of the shooter message and a second angle of attack value based on a determined geometry between the weapon and the target.

The present invention also relates to a shooting training system, comprising

- a plurality of weapon systems, each weapon system being arranged to provide shooter information upon detected firing of a weapon of the weapon system, said shooter information comprising time marked firing information and first pairing information related to the weapon,
- at least one target system arranged to provide time marked hit/miss information and second pairing information related to a target of the target system, and
- an evaluation system according to the above.

In one example the weapon systems of said shooting training system comprises a fire detection unit arranged to detect fire of ammunition from the weapon, a time marking unit arranged to time mark information related to the detected fire, a first pairing unit arranged to form first paring information, and a transmitter arranged to transmit the shooter message upon detected firing of the weapon.

The time marking unit is for example associated to a time synchronisation generation unit arranged to provide synchronized timing data for time marking the information related to the detected firing.

The first pairing unit comprises in one example a memory arranged to store information related to an ID, weapon type and ammunition type and an input device for inputting said ID, weapon type and ammunition type information. At least the first pairing unit may comprise a GPS receiver arranged to provide geographical position and possibly velocity information. The first pairing unit may comprise a compass for angle of attack pairing.

The target system(s) of the shooting training system comprises in one example an ammunition detection unit arranged to detect ammunition hits and/or passages of the ammunition within a predetermined detection area associated to the target of ammunition from the weapon, a time marking unit arranged to time mark information related to the detected ammunition, a second pairing unit arranged to provide second pairing information related to the target, and a transmitter arranged to transmit said target message upon detection of an ammunition.

The second pairing unit comprises in one example a unit arranged to determine the characteristics of the ammunition, such as the velocity and/or an angle of attack.

In one example the second pairing unit comprises a GPS receiver arranged to provide geographical position information and possible also velocity information.

The present invention also relates to a method for determining from where ammunition detected at a target was fired.

DETAILED DESCRIPTION

Figure 1:
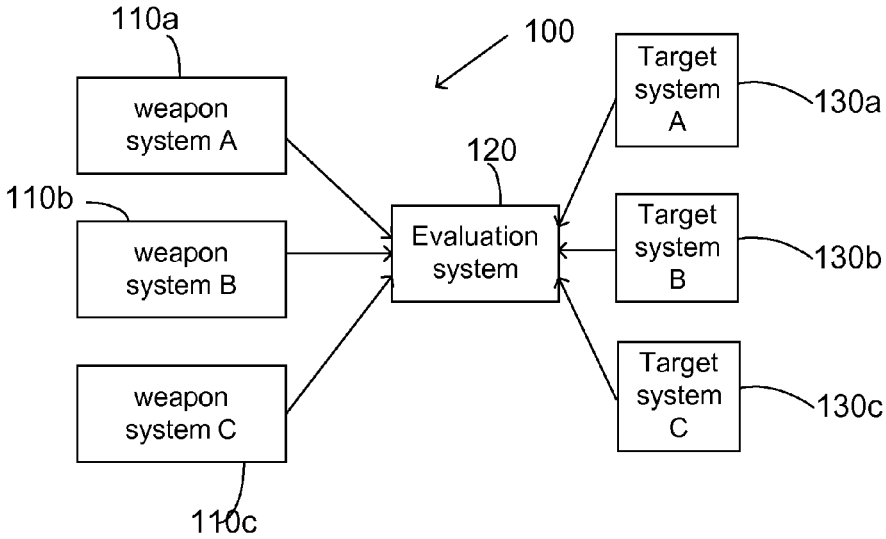
FIG. 1 is a block scheme schematically illustrating a shooting training system according to one embodiment of the invention.

In FIG. 1, a shooting training system 100 comprises a plurality of weapon systems 110*a*, 110*b*, 110*c*, a plurality of target systems 130*a*, 130*b*, 130*c* and an evaluation system 120. The shooting training system 100 is in one example a shooting training system for shooting training with live ammunition. The shooting training system 100 is in one example a system for military shooting training. In an alternative example, the shooting training system is used for training of employees within the civil service, for example police forces.

Each weapon system 110*a*, 110*b*, 110*c* of the shooting training system 100 is arranged to provide shooter information upon detected firing of a weapon (denoted 240 in FIG. 2) associated to the system 110*a*, 110*b*, 110*c*. The shooter information comprises time marked firing information and first pairing information related to the weapon. The first pairing information will be discussed below. In FIG. 1, three weapon systems A, B, C 110*a*, 110*b*, 110*c* are shown for reasons of simplification. In practice, the shooting training system 100 comprises often tens or hundreds of weapon systems. The weapons used in the weapon systems are for example hand guns, rifle weapons, pistols, machine guns, assault rifles, light machine guns, sniper rifles, heavy machine guns, anti-material rifles, etc. Each participant in the shooting training is equipped with a weapon system.

The target systems 130*a*, 130*b*, 130*c* of the shooting training system 100 are each arranged to provide time marked hit/miss information for a target (denoted 450 in FIG. 4) of the target system and second pairing information related to the target. The second pairing information will be discussed below. In the non-limiting example of FIG. 1, the shooting training system 100 comprises three target systems 130*a*, 130*b*, 130*c*. The target comprises in one example a mechanism which is able to suddenly display the target in any position and in any configuration in front of the participants. For example, the mechanism is in one example arranged to make the target visible by a so-called pop-up, a swing-out, or a rotary movement of the target. Further, the targets can be arranged to move on rails or the like, so as to be movable in front of the participants.

The evaluation system 120 of the shooting training system 100 is arranged to determine from which weapon fired ammunition detected by the target system was fired. In one example, the evaluation system 120 is formed as a central unit arranged to communicate with each weapon system 110*a*, 110*b*, 110*c* and each target system 130*a*, 130*b*, 130*c*. In an alternative example, each target system 130*a*, 130*b*, 130*c* is associated to one corresponding evaluation system 120. Each evaluation system 120 is then arranged to communicate with each weapon system and at least with that target system to which it is associated. The weapon systems 110*a*, 110*b*, 110*c* and the target systems 130*a*, 130*b*, 130*c* are arranged to communicate with the evaluation system(s) 120 for example by means of radio communication, wired communication or wireless communication of any type.

Figure 2:
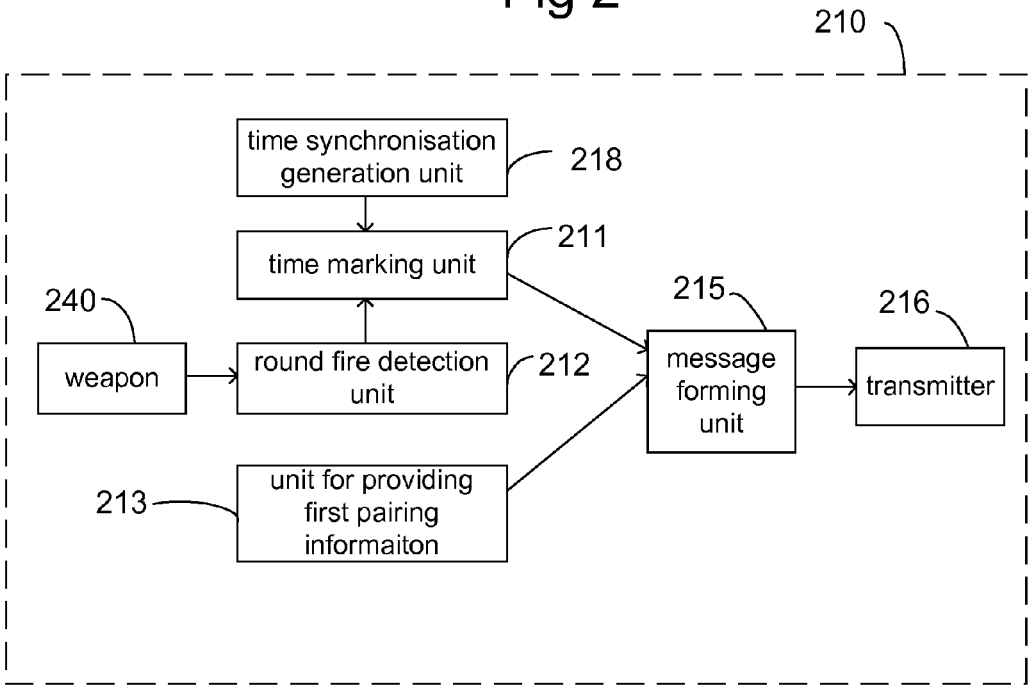
FIG. 2 is a block scheme schematically illustrating an example of a weapon system of the shooting training system in FIG. 1.

In FIG. 2, a weapon system 210 comprises or is operatively connected to a weapon 240. The weapon system 210 is, as stated above arranged to provide shooter information upon detected firing of the weapon 240. The shooter information comprising time marked firing information and first pairing information related to the weapon 240. The weapon system 210 comprises a fire detection unit 212 arranged to detect fire of ammunition from the weapon 240. The fire detection unit 212 is in one example a shock sensor mounted on the weapon and arranged to detect vibrations in the weapon arisen from firing of the weapon. In an alternative example, the fire detection unit 212 comprises a flame detector arranged to detect IR signatures arisen from firing of the weapon. Alternatively, the fire detection unit comprises a combination of both. In yet another example, the fire detection unit 212 is arranged to sense pull of a trigger associated to the weapon. Upon detecting fired ammunition, the fire detecting unit 212 is arranged to provide firing information to a time marking unit 211. The time marking unit 211 is arranged to associate time information to the firing information provided by the fire detection unit 212 so as to provide time marked firing information. The time marking unit 211 is in the illustrated example operatively connected to a time synchronisation generation unit 218 arranged to provide the time information. The time synchronisation unit 218 is arranged to provide synchronized time data to the time marking unit 211. The time synchronisation unit 218 comprises in one example a GPS-receiver arranged to provide the time information. In an alternative example, the time synchronisation unit 218 comprises a receiver arranged to receive time information from a radio network of any kind arranged to provide time data.

The weapon system 210 comprises further a first pairing unit 213 arranged to form first paring information. As will be described in detail below, the evaluation system 120 will use the first pairing information and second pairing information from the target systems 130*a*, 130*b*, 130*c* in matching detected ammunition at one of the targets with firing from one of the weapons. The first pairing information will be used by the evaluation system 120 so as to enhance the shooting and target message pairing probability. The first pairing unit will be described more in detail in relation to FIG. 3.

The weapon system 210 comprises further a message forming unit 215 arranged to form a shooter message upon detection of the fired ammunition. In one example, the message forming unit 215 is arranged to form the shooter message based on the time marked fire information and the first pairing information. The message forming unit 215 is arranged to feed the shooter message to a transmitter 216 for transmission to the evaluation system 120.

Figure 3:
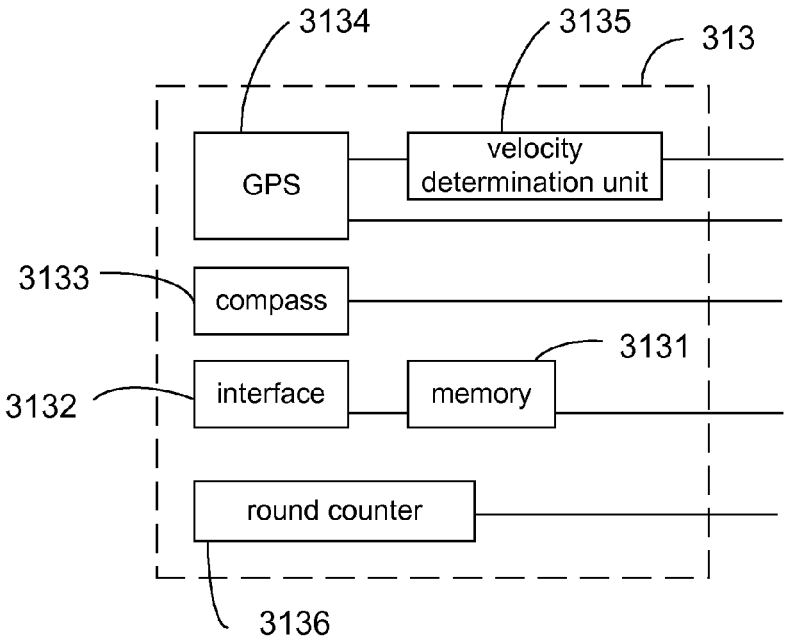
FIG. 3 is a block scheme schematically illustrating an example of a unit for providing first pairing information in the weapon system in FIG. 2.

In FIG. 3, a unit for providing first pairing information 313 of the weapon system 210 comprises an interface 3132 associated to a memory 3131. A user of the system can input information by means of the interface 3132. The inputted information is then stored in the memory 3131. Information can also be pre-stored in the memory 3131. In one example, the information inputted or pre-stored in the memory comprises ID information concerning a unique identity related to the weapon 240. In an alternative or complementary example, the information inputted or pre-stored relates to the used ammunition type and/or the used weapon type.

In the shown example, the unit for providing first pairing information 313 comprises further a compass 3133. In one example, the compass is arranged to determine the compass bearing of a shooting direction of the weapon. In an alternative example, the compass is arranged to determine the compass bearing in direction being angularly displaced in relation to the shooting direction of the weapon. In this example, the angular displacement is known. In one example, the compass is a high precision compass arranged to measure with an accuracy of about 1° or better. In the shown example, the unit for providing first pairing information 313 comprises further a GPS-receiver 3134 arranged to provide position information. In one example one GPS-receiver is used both for providing the position information and for providing the synchronized time data discussed above. In one example, the GPS-receiver 3134 is substituted with another type of device for providing position information, for example based on another type of satellite based positioning system. In the shown example, the device for providing positioning information is connected to a unit 3135 for determining the velocity of the weapon system 110 based on the positioning information. In the illustrated example, the first pairing unit 313 comprises further a round counter 3136. The first pairing information unit 313 is arranged to provide the following information to the message forming unit 215: information related to the used ammunition type and/or the used weapon type, and ID information related to the shooter weapon. The first pairing information unit 313 is in one example further arranged to provide at least some of the following information to the message forming unit 215: a compass bearing of the shooting direction, round counter information, positioning information, and/or velocity information.

Figure 4:
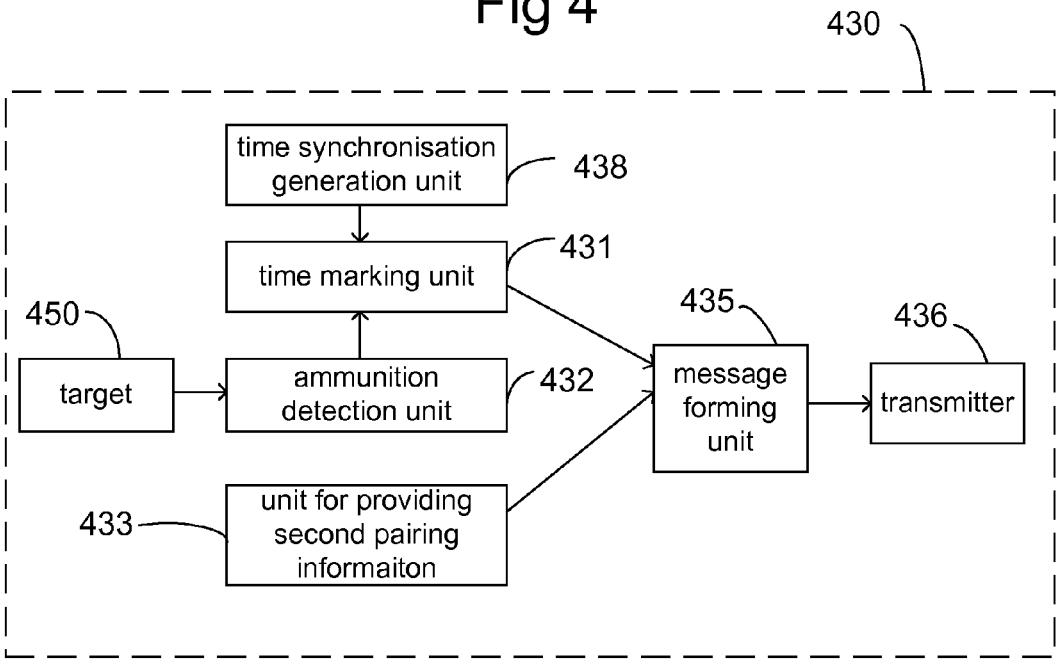
FIG. 4 is a block scheme schematically illustrating an example of a target system of the shooting training system in FIG. 1.

In FIG. 4, a target system 430 comprises or is operatively connected to a target 450. The target system 430 is, as stated above arranged to provide target information upon detection of ammunition. The target information comprises time marked hit/miss information and second pairing information related to the target 450.

The target system 430 comprises an ammunition detection unit 432 arranged to detect hits and/or passages of the ammunition fired from one of the weapons 240. The ammunition detection unit 432 is in one example arranged to detect hits by means of one or a plurality of sensors mounted on the target. The sensors are for example arranged to sense vibrations or chocks. The sensors comprises in one example thermal sensors. In one example, an output from the sensors is processed so as to determine coordinates for the hit. The ammunition detection unit 432 is in one example arranged to detect passages within a predetermined detection area associated to the target and to register said detected passages as a near miss. In one example, the predetermined detection area has a diameter of 3 meters, and in an alternative example, the predetermined detection area has a diameter of 1 meter. The ammunition detection unit 432 comprises in one example a shock sensor mounted on the target and arranged to detect vibrations originating from passage of ammunition. In an alternative example, the ammunition detection unit 431 comprises an audio sensor arranged to detect audio signals arisen from passage of ammunition. In one example, the ammunition detection unit 431 comprises a plurality of microphones. In one example, the ammunition detection unit comprises four to six microphones, for example six microphones. The microphones are each arranged to detect the wave front formed at passage of the ammunition. Based on the different times of passages of the wave front at the different microphones, a velocity of the ammunition can be determined. Further, based on said the different times of passages of the wave front at the different microphones, an angle of attack of the ammunition can be determined. Further, based on said the different times of passages of the wave front at the different microphones, a calibre class of the detected ammunition can be determined. Further, the coordinates of the target impact or ammunition passing can be determined.

Upon detecting a hit or near miss, the ammunition detecting unit 432 is arranged to provide target information to a time marking unit 431. The time marking unit 431 is arranged to associate time information to the target information provided by the ammunition detection unit 432 so as to provide time marked target information. The time marking unit 431 is operatively connected to a time synchronisation generation unit 438 arranged to provide the time information. The time synchronisation unit 438 is arranged to provide synchronized time data to the time marking unit 431. The time synchronisation unit 438 comprises in one example a GPS-receiver arranged to provide the time information. In an alternative example, the time synchronisation unit 438 comprises a receiver arranged to receive time information from a radio network of any kind arranged to provide time data.

The target system 430 comprises further a second pairing unit 433 arranged to form second paring information. As was stated above, the evaluation system 120 will use the first pairing information and second pairing information from in matching detected ammunition with firing from one of the weapons. The second pairing information will be used by the evaluation system 120 so as to determine information related to the enhanced shooter and target message pairing probability. The second pairing unit 433 will be described more in detail in relation to FIG. 5.

The target system 430 comprises further a message forming unit 435 arranged to form a target message upon detection of the ammunition. In one example, the message forming unit 435 is arranged to form the target message based on the time marked target information and the second pairing information. The message forming unit 435 is arranged to feed the target message to a transmitter 436 for transmission to the evaluation system 120.

Figure 5:
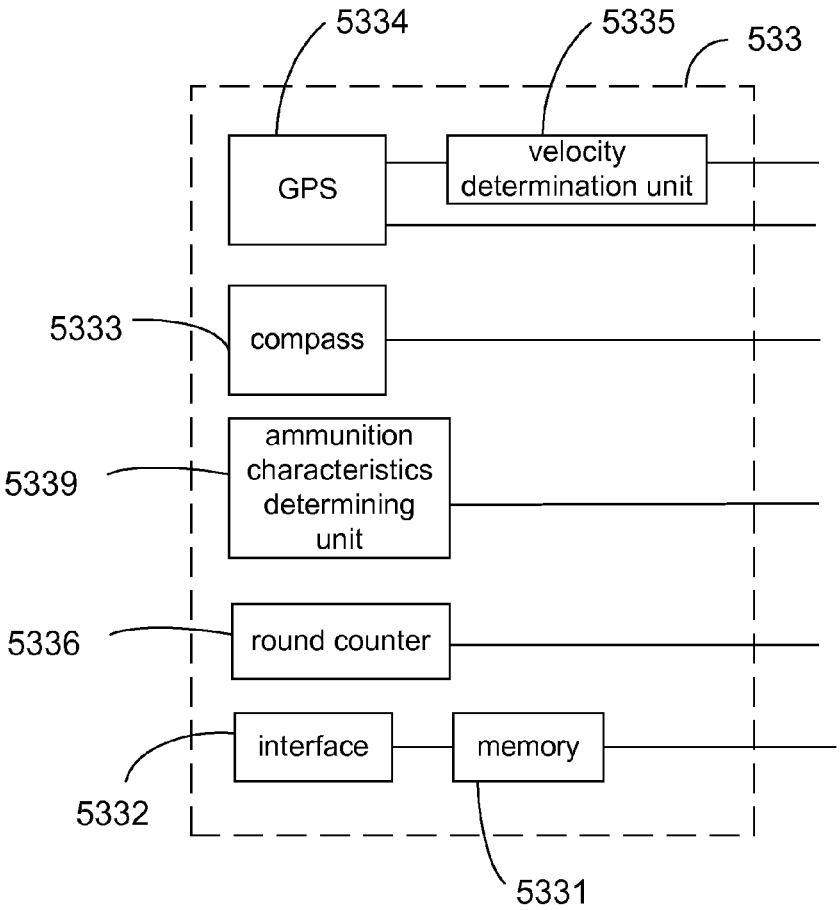
FIG. 5 is a block scheme schematically illustrating an example of a unit for providing second pairing information in the target system in FIG. 4.

In FIG. 5, a unit for providing second pairing information 533 of the target system 430 comprises in the illustrated example an ammunition characteristic determining unit 5339. The ammunition characteristics determining unit 5339 is arranged to determine the velocity and/or an angle of attack and/or a calibre of the ammunition detected by the ammunition detection unit 432. In one example, the ammunition detection unit 432 and the ammunition characteristics determining unit 5339 are formed by sensors as for example those previously described in relation to the unit 432.

In the shown example, the unit for providing second pairing information 533 comprises further a compass 3133. In one example, the compass is arranged to determine the compass bearing in a direction of an axis perpendicular to a hit surface of the target. In an alternative example, the compass is arranged to determine the compass bearing in a direction being angularly displaced in relation to the axis above. In this example, the angular displacement is known. In one example, the compass is a high precision compass measuring with an accuracy of about 1° or better. In the shown example, the unit for providing second pairing information 533 comprises further a GPS-receiver 5334 arranged to provide position information. Alternatively, the GPS-receiver 5334 is substituted with another type of device for providing position information, for example based on another type of satellite based positioning system. In one example, one GPS-receiver is used for providing both the positioning information and the time synchronized data for time marking hits/near misses, as discussed above. In the shown example, the device for providing positioning information is connected to a unit 5335 for determining the velocity of the target system 430 based on the positioning information. The second pairing unit comprises in the illustrated example further an interface 5332 associated to a memory 5331. A user of the system can input information by means of the interface 5332. The inputted information is then stored in the memory 5331. Information can also be pre-stored in the memory 5331. In one example, inputted or pre-stored information relates to an identity of the target 450 of the target system 430. In the illustrated example, the second pairing unit comprises further a round counter 5336. In accordance with this example, the round counter 5336 is arranged to increase a counter value for each detected shot in a round of ammunition, and associate said counter value to the detected shot.

The second pairing information unit 533 is arranged to provide identity (ID) information related to the target to the message forming unit 435. In one example, the second pairing information unit 533 is arranged to further provide at least some of the following information to the message forming unit 435: the information related to characteristics of the of the detected ammunition such as velocity and/or an angle of attack and/or calibre of the ammunition, a compass bearing of the targets direction, round counter information related to the target, positioning information related to the target, velocity information related to the target.

Figure 6:
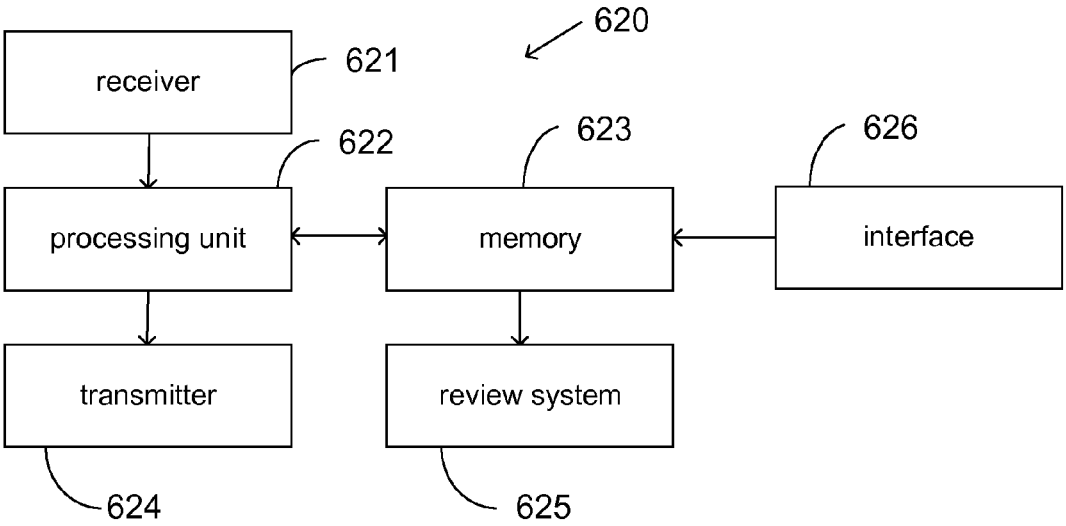
FIG. 6 is a block scheme schematically illustrating an example of an evaluation system of the shooting training system in FIG. 1.

In FIG. 6, an evaluation system 620 comprises a receiver unit 621 arranged to receive shooter messages from a plurality of weapon systems 110 and to receive target messages from one or a plurality of target systems 130. Each shooter message comprises at least the time marked firing information and first pairing information discussed above. Each target message comprises at least the time marked hit/miss information and second pairing information as discussed above. The evaluation system 620 comprises further a memory 623 arranged to store the received shooter messages and target messages.

The evaluation system 620 comprises further a processing unit 622 arranged to pair each target for which a hit or near miss has been detected (i.e each received target message) with one associated weapon (i.e. a selected one of the received shooter messages) based on the received target messages and the received shooter messages. Such indentified pairing is hereinafter defined as a match. In detail, when one target message has been received, the processing unit 622 is in one example arranged to determine a first time of flight value related to a time difference between the hit/miss information of the received target message and the firing information of those shooter messages which are determined to have been time stamped within a suitable maximum time period. The suitable maximum time period is in one example a predetermined time period based on an assumed maximum distance between the target and shooters and based on an assumed minimum velocity of the ammunitions. The processing unit 622 is further arranged to determine a second time of flight value based on the second pairing information of the received target message and the first pairing information of each shooter message time stamped within the suitable time period. The processing unit 622 is in accordance with this example then arranged to pair the target object associated to the received target message with one associated weapon based on the first and second time of flight values so as to provide a match.

In one example, the first pairing information in the shooter message comprises information related to the flight characteristics of the ammunition and/or weapon; in practice, that information is provided in the form of the ammunition type and/weapon type information, which can be converted to flight characteristics information. This will be described in detail below. The second pairing information in the target message comprises information related to a velocity of the ammunition at the target. In this example, the processing unit 622 is arranged to determine the second time of flight value based on the characteristics of the flight of the ammunition and the velocity of the ammunition at the target. In detail, the processing unit is then in accordance with one example arranged to determine the location of the ammunition in the flight path upon detection, based on the measured velocity of the ammunition and based on knowledge provided from the flight characteristics about where in the flight path the ammunition has a given velocity. The determined location of the ammunition in the flight path can thereafter be converted into the second time of flight value based on the known flight characteristics of the ammunition.

In an alternative example, the first pairing information comprises information related to the flight characteristics of the ammunition and/or weapon and to the position of the weapon. The second pairing information comprises then for example information related to the position of the target. The processing unit 622 is then arranged to determine the second time of flight value for each weapon based on the flight characteristics of the ammunition fired from each weapon and based on a distance between the weapon and the target determined based on the position information of the shooter message and the target message. The velocity of the ammunition at the target can also be comprised in the second pairing information of the target message, and be used so as to improve the calculation of the second time of flight value. The velocity of the weapons and/or target can also be comprised in the first and/or second pairing information, and be used so as to improve the calculation of the second time of flight value.

The processing unit 622 can further be arranged to pair the target with the associated weapon based on angle of attack pairing so as to provide a match. In accordance with this example, the first pairing information comprises information related to an angle of attack of the weapon. Further, the first and second pairing information comprises in one example information related to the position of the weapon and the target object, respectively. The processing unit 622 is then arranged to determine a first angle of attack value based on the angle of attack information of the shooter message and a second angle of attack value based on a determined geometry between the weapon and the target. In one example, the angle of attack pairing is used as a complement to the time of flight pairing so as to discriminate weapons from each other being at about the same distance from the target. Accordingly, the processing unit 622 is in accordance with this example first arranged to pair the target object with a subset of weapons for which the difference between the first and second time of flight values lies within a predetermined uncertainty interval around zero. For this subset of weapons, the processing unit 622 is then arranged to pair the target object with one associated weapon based on the first and second angle of attack values so as to provide a match.

The evaluation system 620 comprises further a transmitter 624 arranged to transmit information related to the determined match. In one example, the evaluation system 620 is arranged to transmit the matching information as a hit/near miss message to that weapon which has been paired with one target. Alternatively, or in addition thereto, the evaluation system 620 is arranged to store the matching information as hit/near miss information in the memory 623.

In one example, the first pairing information of the shooter messages comprises ID information related to the identity of the weapon. In an alternative or complementary example, the second pairing information of the target messages comprises ID information related to the identity of the target. Accordingly, the matching information comprises in one example the identity of the target and/or the associated weapon.

In one example, the first pairing information of the shooter messages comprises round counter information. In accordance with this example, each fired shot (and accordingly each shooter message) in a round of ammunition is associated to a counter value. Then, the counter value related to the fired shot can in one example be comprised in the matching information. Further, in one example, the second pairing information of each target message comprises round counter information related to a count value in a round of ammunition detected at the target. In accordance with this example, each detected fired shot (and accordingly each target message) in a round of ammunition is associated to a counter value. Then, the counter value related to the received shot can in one example be comprised in the matching information.

The evaluation system 620 comprises further in the shown example a review system 625. The review system is for example arranged to provide statistics from the shooting training. For example, it can be extracted how many times each weapon has been fired, how many hits and/or near misses each weapon has caused, and how many times each target has been hit. All firing, hit and near miss events can be extracted with a time label associated to it. If the participants and the target systems in the practice are equipped with devices for positioning (e.g. GPS-receivers), the review system can be arranged to display on a display device the movements of the participants and the location and time for each event. The device for positioning may in one example be arranged to use information related to the orientation of the target. The position and orientation of the target system (130; 430) may in one example be inputted by means of the interface 626. Alternatively, the position and orientation information is provided by means of a GPS-receiver and a compass on the target system 130; 430. The position of the weapon system may in one example determined using information related to the position and orientation of the target system and the secondary pairing information comprising for example ammunition angle of attack and ammunition velocity information.

The evaluation system 620 comprises as mentioned above in one example an interface 626. A user of the evaluation system can input information by means of the interface 626. The inputted information is then stored in the memory 623. Information can also be pre-stored in the memory 623. In one example, the inputted or pre-stored information relates to the ammunition types and/or the weapon types used in the training. The inputted or pre-stored information comprises for example information related to flight characteristics of each ammunition and/or weapon type. Alternatively, the inputted or pre-stored information comprises ammunition type and/or weapon type information. Accordingly, the flight characteristics can be determined based on pre-stored characteristics for different kinds of ammunitions and/or weapons and/or based on pre-stored algorithms for calculating flight characteristics for different types of ammunitions and/or weapons. In one example, the information inputted or pre-stored in the memory comprises also ID information concerning identities related to the weapons.

In order to provide accurate information related to the flight characteristics of the ammunition and/or weapons in use, the system is calibrated before use. The flight characteristics of the ammunition used is influenced by for example weather conditions. In order to cope with that, flight characteristic curves or algorithms for the flight characteristics stored in the memory are calibrated before use of the shooting training system. The calibration involves testing those ammunition types used in the training. The testing involves in one example determining the flight time of the ammunition travelling a known distance. In one example, the flight times are determined for a number of distances. In one example, the determined flight times are inputted by means of the interface 626, and the processing unit is then used to adapt the curve and/or algorithm for each ammunition type to the determined flight time/distance pair(s). In one example, the velocity of the ammunition is measured at one or a plurality of known locations in the trajectory and said measured velocity/velocities is/are used for further improving the accuracy of the curve or algorithm. In the shown example, the flight time information, distance information and possibly velocity information for each ammunition and/or weapon type, is inputted by means of the interface 626 in a calibrating mode of operation. In the calibrating mode of operation, the processing unit 622 is arranged to perform the adaptation of the curves or algorithms stored in the memory 623 based on the inputted flight time information, distance information and possibly velocity information for each ammunition and/or weapon type. The adapted curves or algorithms are then stored in the memory 623.

Figure 7:
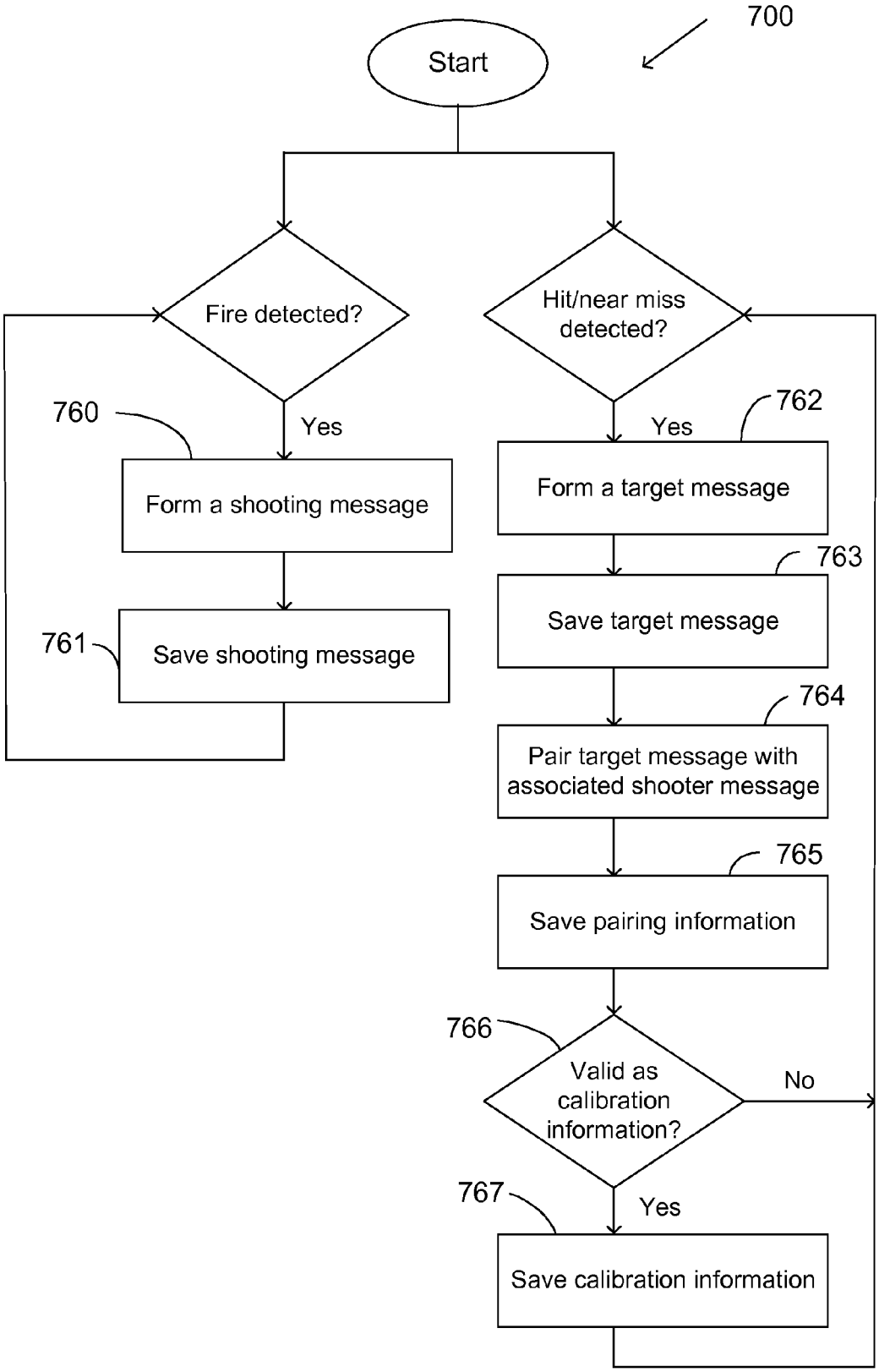
FIG. 7 is a flow chart illustrating a method for associating a target to a shooter.

In FIG. 7, a method 700 for determining from where ammunition detected at a target was fired comprises the steps of

- forming and saving a shooting message in dedicated steps 760, 761 each time a weapon fires ammunition based on time marked fire information and first pairing information, and
- upon detection of a hit/near miss at the target, forming and saving a target message in dedicated steps 762, 763 based on time marked hit/miss information and second pairing information, and thereafter pairing the target with one associated weapon in an dedicated step 764 based on the information in the target message and each respective shooting message, and finally saving 765 said pairing information. In a following step 766, it is in the illustrated example evaluated whether the information in the messages provided from the shooter and target systems comprises information which can be used in calibrating the flight characteristics of the ammunition. This calibration information is then saved in the memory of the evaluation system in a saving step 767. The calibration information can then be used so as to increase the accuracy of the stored flight characteristic curves or algorithms.

The invention claimed is:

1. An evaluation system for shooting training arranged to determine from which shooter a fired live ammunition detected by a target system is fired, said evaluation system comprising:

a receiver unit arranged to receive shooter messages from a plurality of weapon systems, each shooter message comprising time marked firing information regarding the firing of the live ammunition and first pairing information related to a weapon of the weapon system, and to receive target messages from the target system, each target message comprising time marked hit/miss information and second pairing information related to a target of the target system, and a processing unit arranged to pair the target with one associated weapon based on the target message and each respective shooter message.

2. The evaluation system according to claim 1, wherein the processing unit is arranged to determine a first time of flight value related to a time difference between the hit/miss information of the target message and the firing information of each shooter message, determine a second time of flight value based on the second pairing information of the target message and the first pairing information of each shooter message, and pair the target with one associated weapon based on the first and second time of flight values.

3. The evaluation system according to claim 2, wherein the first pairing information comprises information related to flight characteristics of the ammunition and/or weapon.

4. The evaluation system according to claim 3, wherein the second pairing information comprises information related to a velocity of the ammunition at the target, and wherein the processing unit is arranged to determine the second time of flight value based on the characteristics of the flight of the ammunition and the velocity of the ammunition at the target.

5. The evaluation system according to claim 3, wherein the first and second pairing information comprises information related to the position of the weapon and the target object, respectively, and wherein the processing unit is arranged to determine the second time of flight value for each weapon based on the characteristics of the flight of the ammunition and a determined distance between the weapon and the target.

6. The evaluation system according to claim 1, wherein the processing unit is further arranged to pair the target with the associated weapon based on angle of attack pairing.

7. The evaluation system according to claim 6, wherein the first pairing information comprises information related to an angle of attack of the weapon and wherein the first and second pairing information comprises information related to the position of the weapon and the target object, respectively, and wherein the processing unit is arranged to determine a first angle of attack value based on the angle of attack information of the shooter message and a second angle of attack value based on a determined geometry between the weapon and the target.

8. A shooting training system, comprising:

a plurality of weapon systems, each weapon system being arranged to provide shooter information upon detected firing of live ammunition from a weapon of the weapon system, said shooter information comprising time marked firing information and first pairing information related to the weapon, at least one target system arranged to provide time marked hit/miss information and second pairing information related to a target of the target system, and an evaluation system comprising a receiver unit arranged to receive shooter messages from a plurality of weapon systems, each shooter message comprising time marked firing information regarding the firing of the live ammunition and first pairing information related to a weapon of the weapon system, and to receive target messages from the target system, each target message comprising time marked hit/miss information and second pairing information related to a target of the target system, and a processing unit arranged to pair the target with one associated weapon based on the target message and each respective shooter message.

9. The shooting training system according to claim 8, wherein each weapon system further comprises a fire detection unit arranged to detect fire of ammunition from the weapon, a time marking unit arranged to time mark information related to the detected fire, a first pairing unit arranged to form first paring information, and a transmitter arranged to transmit the shooter message upon detected firing of the weapon.

10. The shooting training system according to claim 9, wherein the time marking unit is associated to a time synchronisation generation unit arranged to provide synchronized timing data for time marking the information related to the detected firing.

11. The shooting training system according to claim 9, wherein the first pairing unit comprises a memory arranged to store information related to weapon type and an ammunition type and an input device for inputting said weapon type and ammunition type information.

12. The shooting training system according to claim 9, wherein the first pairing unit comprises a compass.

13. The shooting training system according to claim 8, wherein each target system further comprises an ammunition detection unit arranged to detect ammunition hits and/or passages of the ammunition within a predetermined detection area associated to the target of ammunition from the weapon, a time marking unit arranged to time mark information related to the detected ammunition, a second pairing unit arranged to provide second pairing information related to the target, and a transmitter arranged to transmit said target message upon detection of an ammunition.

14. The shooting training system according to claim 13, wherein the second pairing unit comprises a unit arranged to determine the velocity of the ammunition.

15. A method for determining from where ammunition detected at a target was fired, the method comprising:

forming a shooting message each time a weapon fires ammunition based on time marked fire information regarding the firing of the live ammunition and first pairing information, and upon detection of said ammunition at the target, forming a target message based on time marked hit/miss information and second pairing information, and pairing the target with one associated weapon based on the information in the target message and each respective shooting message.

16. The shooting training system according to claim 12, wherein the compass comprises a high precision compass for angle of attack pairing.

* * * * *